United States Patent [19]

Kitzner

[11] 4,241,580

[45] Dec. 30, 1980

[54] STIRLING ENGINE

[75] Inventor: Ernest W. Kitzner, Allen Park, Mich.

[73] Assignee: Ford Motor Company, Dearborn, Mich.

[21] Appl. No.: 964,865

[22] Filed: Nov. 30, 1978

[51] Int. Cl.[3] ..... F02G 1/04

[52] U.S. Cl. ..... 60/522; 60/526

[58] Field of Search ..... 60/517, 522, 524, 525, 60/526

[56] References Cited

U.S. PATENT DOCUMENTS

| | | | |
|---|---|---|---|
| 2,480,525 | 8/1949 | Van Weenen | 60/525 |
| 3,145,527 | 8/1964 | Morgenroth | 60/522 |

*Primary Examiner*—Allen M. Ostrager
*Assistant Examiner*—Stephen F. Husar
*Attorney, Agent, or Firm*—Joseph W. Malleck; Keith L. Zerschling

[57] ABSTRACT

A closed fluid working system for a Stirling engine is disclosed. The working system has a plurality of chambers subdivided by double-acting pistons operating therein; the subdivided chambers are respectively hot and cold and connected in series whereby a hot chamber is always in communication with a cold chamber of the next most adjacent cylinder. Parallel arranged gas flow paths are interposed in each communication between hot and cold chambers, and regenerator-cooler mechanisms are disposed in each of said parallel arranged paths. Control means are employed to permit flow through one or more of said parallel paths or flow of different levels through all of the paths, during different load conditions of the engine to permit the regenerator-cooling capacity to be tuned to the needs of the engine.

3 Claims, 1 Drawing Figure

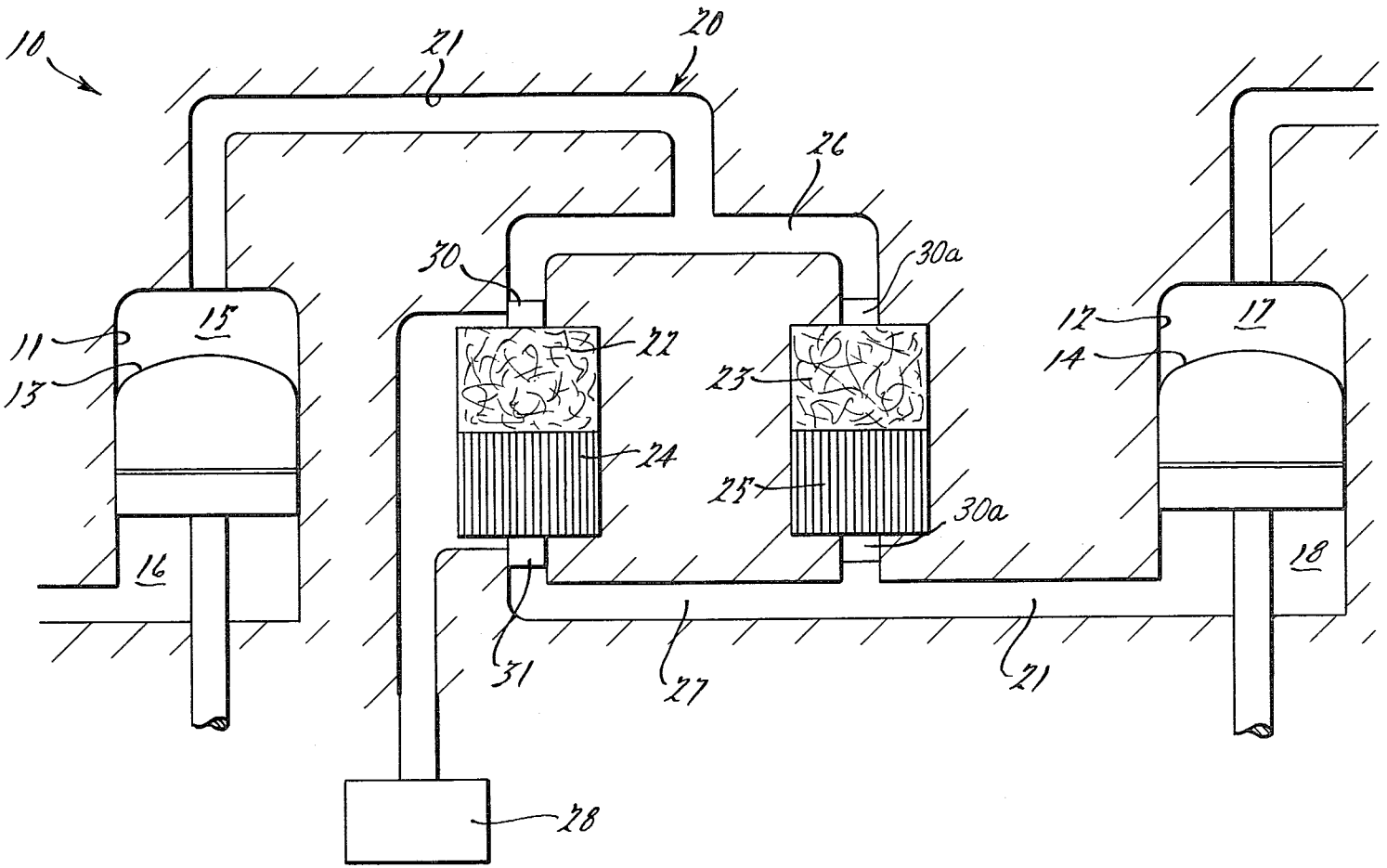
10
11
13
15
16
20
21
22
23
24
25
26
27
28
30
30a
31
12
14
17
18

STIRLING ENGINE

BACKGROUND OF THE INVENTION

The Stirling cycle requires two volumes interconnected by a dead space having a regenerator included in the latter. One of the volumes is an expansion space, maintained at a generally high temperature, and the other volume is a compression space maintained at a relatively low temperature. The regenerator is equivalent to a thermodynamic sponge, alternately releasing and absorbing heat when gases are transferred between the two volumes. The dead space consists of that part of the working space not swept by any of the pistons operating within the expansion and compression volumes; this dead space typically will include cylinder clearance spaces, void volumes of the regenerator or heat exchangers, and the internal volume of the associated ducts and ports interconnecting the two volumes.

The amount of flow through the dead space, during each cycle of operation of the Stirling engine is important because flow losses therein affect the net cycle output and the efficiency of the engine. Emperical data has been employed to date to guide the design of the dead space and thereby the regenerator configuration of a Stirling engine.

For example, it has been found that the desirable characteristics for a regenerator matrix should comprise: (a) for maximum heat capacity, a large solid matrix; (b) for maximum heat transfer, a large, finely-divided matrix; (c) for minimum flow losses, a small, highly porous matrix; and (d) for minimum dead space, a small, dense matrix. Clearly, it is impossible to satisfy all of these conflicting requirements. Therefore, with the present state of art for the Stirling cycle, a compromise has been employed; this compromise has resulted in what is known as a fixed regenerator design which will not vary in volume or flow capacity in spite of the fact that the engine itself provides different gas volume flow patterns under different engine loading conditions. Thus, use of a fixed regenerator matrix geometry results in variable flow losses and heat transfer characteristics, dependent on engine operating conditions. Because regenerators are normally sized in order to satisfy some maximum operating condition, part-load efficiency may be improved by modifying the regenerator matrix relative to the full-load requirements.

The difficulty of designing a regenerator system for a Stirling engine is further complicated by the fact that the time for a particle to pass through the regenerator matrix is small compared to the total blow-time; in a Stirling engine, blow times are exceedingly short. For example, at a moderate engine speed of 1200 revolutions/min. or 20 cycles per second, the blow time is 10 times less than the permissible minimum in a gas turbine engine. Since the blow times are so short, it has been demonstrated by other authors that no gas particle passes straight through the regenerator matrix in a single cycle. The actual net flow time through the matrix is about half the complete cycle time, the remaining time being occupied in either filling or emptying, the dead space. As a result, the heat transfer process that occurs is very complex, which involves a repetitive fluid to matrix, matrix to fluid, fluid to matrix cyclic relationship.

It is important therefore that the dead space and regenerator design be improved to permit some adjustment to the changing flow pattern required under different operating conditions.

SUMMARY OF THE INVENTION

A primary object of this invention is to provide for variable regenerator and cooler capacity in a Stirling cycle engine.

Another object of this invention is to provide a Stirling cycle apparatus which is capable of varying the restriction to flow between the expansion and compression spaces of the engine.

Features pursuant to the above objects comprise: (a) the use of more than one set of a regenerator-cooler, and means for regulating flow through one or more of these sets; and (b) the employment of valves at the entrance and exit of each of a plurality of such regenerator-cooler devices, each of the valves being selectively controlled so that flow can be passed through one or more of said arrangements.

SUMMARY OF THE DRAWINGS

The FIGURE is a schematic illustration of a portion of a working fluid system of a Stirling engine embodying the principles of this invention.

DETAILED DESCRIPTION

Turning to the FIGURE, a portion of a closed working fluid system 10 of the Stirling-type engine is shown having the pistons arranged in a double acting manner. A plurality of cylinders, two of which are shown here as 11 and 12, have the volume therein each respectively subdivided by pistons or reciprocating heads 13 and 14 so that each cylinder will have the variable volume therein comprised of a high temperature (hot) space and a low temperature (cold) space. The hot space acts as an expansion volume and the cold space acts as a compression volume. For example, with respect to cylinder 11, the hot space is identified as 15 and the low temperature space as 16; with respect to cylinder 12, the hot space is identified as 17 and the low temperature space as 18. Each hot space of one cylinder is connected by a suitable communicating means 20 to a low temperature space of the next most adjacent cylinder. Such communicating means comprises a gas passage 21 in which is interposed a plurality of regenerator-cooling apparatus, connected together by a bifurcated passage 26 at their entrance and by a bifurcated passage 27 at their exit. Each apparatus function in a known manner whereby gas displaced from the hot chamber passes through the regenerator (22 or 23) transferring heat units thereto and is thence cooled by cooling mechanism 24 or 25) before entering the low temperature space. Such gases are again displaced during a subsequent phase of the Stirling cycle, from the low temperature space back through the passage 21 absorbing heat units from the regenerator, and again re-entering the hot chamber.

In a practical application, all gas particles may not undergo a complete translation from the hot to the cold chambers, but rather there is thermal conduction that takes place through some of the gas medium that is directed along such path.

The use of a pair of regenerator-cooler mechanisms connected in parallel as shown in FIG. 1, permits the use of two different Stirling cycles within the same engine. By placing valves 30 and 31 at the respective entrance and exit of one regenerator-cooler mechanism, the working gas flow through this mechanism can be shut off for low load or normal road load engine operation. This would then allow the design of the engine using only regenerator 23 and cooler 25 for mechanism for low load at maximum efficiency. When higher loads are required, the valves can then be opened. The size or design of each regenerator-cooler mechanism in each set could be different, particularly to achieve the condition of maximum efficiency or power; flow losses during the low load could be reduced to an optimum.

This invention is not an engine control method, but rather a mode of obtaining better efficiency during most normal load conditions. The valves 30 and 31 can be either of the full closing type or of the restrictive type and may be solenoid operated by a remote control 28 or the equivalent. Moreover, valves may alternatively be associated with each of said regenerator-coolers so that a different design operation is achieved by restricting the flow to all of the regenerator-coolers. Thus, valves 30–31 as well as valves **30*a*–30*a*** would be utilized in carrying out this alternative. Moreover, it may only be necessary to employ one valve instead of the two as illustrated.

The control and operation of a double acting hot gas type Stirling engine is more typically described in the prior art and specific reference herein is made to U.S. Pat. No. 3,859,792 which demonstrates a system control whereby the main working pressure within said variable spaces is controlled to provide an increase or decrease of engine speed and torque.

I claim:

1. A closed fluid working circuit for a regenerative type Stirling engine having a plurality of chambers subdivided by double-acting pistons operating therein, the subdivided chambers being respectively hot and cold and connected in series whereby a hot chamber is always in communication with a cold chamber of the next most adjacent cylinder, the improvement comprising:

(a) means defining a plurality of parallel arranged gas flow paths between the respective hot chamber and cold chamber of adjacent cylinders;

(b) regenerator-cooler means disposed in each of said parallel arranged gas flow paths, and (c) control means for selectively permitting gas flow through one or more of said regenerator-cooling means.

2. The improvement as in claim 1, in which said control means is effective to restrict flow simultaneously through each of said regenerator-cooler means.

3. The improvement as in claim 1, in which at least one of said regenerator-cooling means is not valve controlled, but remains in the open fully communicated condition at all times.

* * * * *